US006971245B2

(12) United States Patent
Kuroyanagi

(10) Patent No.: US 6,971,245 B2
(45) Date of Patent: Dec. 6, 2005

(54) AUGER TYPE ICE MAKING MACHINE

(75) Inventor: Masayuki Kuroyanagi, Aichi-ken (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/909,349

(22) Filed: Aug. 3, 2004

(65) Prior Publication Data

US 2005/0028549 A1 Feb. 10, 2005

(30) Foreign Application Priority Data

Aug. 8, 2003 (JP) ..... 2003-290415

(51) Int. Cl.[7] ..... F25C 1/14
(52) U.S. Cl. ..... 62/136; 62/277; 62/354
(58) Field of Search ..... 62/136, 277–278, 62/349–352, 354

(56) References Cited

U.S. PATENT DOCUMENTS 2,616,270 A * 11/1952 Field ..... 62/351
3,163,020 A * 12/1964 Ross ..... 62/138
3,650,121 A * 3/1972 Kimpel et al. ..... 62/136
6,694,752 B2 * 2/2004 Nomura et al. ..... 62/136
6,915,647 B2 * 7/2005 Tsuchikawa et al. ..... 62/129

* cited by examiner

*Primary Examiner*—William E. Tapolcai
(74) *Attorney, Agent, or Firm*—Wenderoth, Lind & Ponack, L.L.P.

(57) ABSTRACT

An auger type ice making machine is provided with a control unit for causing a hot gas valve to open and for causing a heater disposed in the vicinity of ice compression passages to perform heating for a time period longer than the opening period of the hot gas valve, in accordance with a detection result from a rotation detecting sensor which detects rotation of a motor rotating an auger. The opening period of the hot gas valve and the heating period of the heater consist of, respectively: a basic opening period and a basic heating period, each corresponding to a time period during which the rpm of the auger is not higher than a threshold value, and an additional opening period and an additional heating period which are respectively added to the basic opening period and the basic heating period and begin at the time when the auger rpm exceeds the threshold value.

3 Claims, 3 Drawing Sheets

AUGER TYPE ICE MAKING MACHINE

BACKGROUND OF THE INVENTION

1. Field of the Invention

The present invention relates to an auger type ice making machine.

2. Description of the Related Art

In an auger type ice making machine, ice-making water supplied into a cylinder is cooled and frozen to form a layer of ice on the inner peripheral surface of the cylinder, and the ice thus formed is scraped off by rotating an auger in the cylinder to provide sorbet-like ice, which is then further compressed to produce suitable particulate ice. When overcooling occurs in such an auger type ice making machine, however, a large load is applied to an ice making mechanism portion, which may lead to such defects as cylinder freeze-up due to ice clogging, noise generation, abnormal wear of bearings, breakage of the auger or a geared motor, etc. In view of this, conventionally, there exists a technique for suppressing the ice making capacity to an optimal state (see, for example, JP 2003-42610 A). That is, high-pressure side hot gas present between a compressor and a condenser in a refrigeration circuit of an auger type ice making machine is bypassed between the compressor and an evaporator. As a result, the refrigerant pressure and the evaporation temperature on the low pressure side rise, thereby reducing the ice making capacity. Further, a heater is arranged in the vicinity of ice compression passages provided above the auger to eliminate occurrence of freeze-up in a stationary blade.

However, in the initial stage of overcooling, it is often the case that the rpm of the auger temporarily decreases due to excessive ice making but immediately recovers to an unproblematic level. Therefore, there is a fear that, in the case where the above-described bypassing of hot gas and energization of the heater are effected in synchronism with dropping of the auger rpm to a predetermined value or below, it may be actually impossible to completely eliminate overcooling. In the case of a heater, in particular, it is installed near the ice compression passages and thus fully cooled prior to its energization. Thus it often takes some time before the heater actually starts to exert an ice-melting effect after it starts heating upon energization. In some conventional implementations, in contrast, the heater is continuously energized.

SUMMARY OF THE INVENTION

The present invention has been made in view of the problems mentioned above, and it is therefore an object of the present invention to provide an auger type ice making machine in which defects due to overcooling can be effectively eliminated from the initial stage of overcooling.

In order to attain the above-mentioned object, according to the present invention, there is provided an auger type ice making machine in which ice formed by freezing on an inner peripheral surface of a cylinder of an ice making mechanism portion is scraped off by an auger and is discharged after being suitably compressed in an ice compression passage, the auger type ice making machine including: a refrigeration circuit including a compressor, a condenser, an expansion valve, and an evaporator; bypass means for supplying a refrigerant on a high pressure side of the refrigeration circuit to a low pressure side; heating means for heating a vicinity of the ice compression passage; overcooling detecting means for detecting overcooling in the ice making mechanism portion; and control means for causing the bypass means open in accordance with a detection result from the overcooling detecting means and initiating heating with the heating means at the same time or after the bypass means is opened, and then, ending heating with the heating means after closing the opened bypass means.

DESCRIPTION OF THE PREFERRED EMBODIMENT

Hereinafter, an embodiment of the present invention is described with reference to the accompanying drawings.

Figure 1:
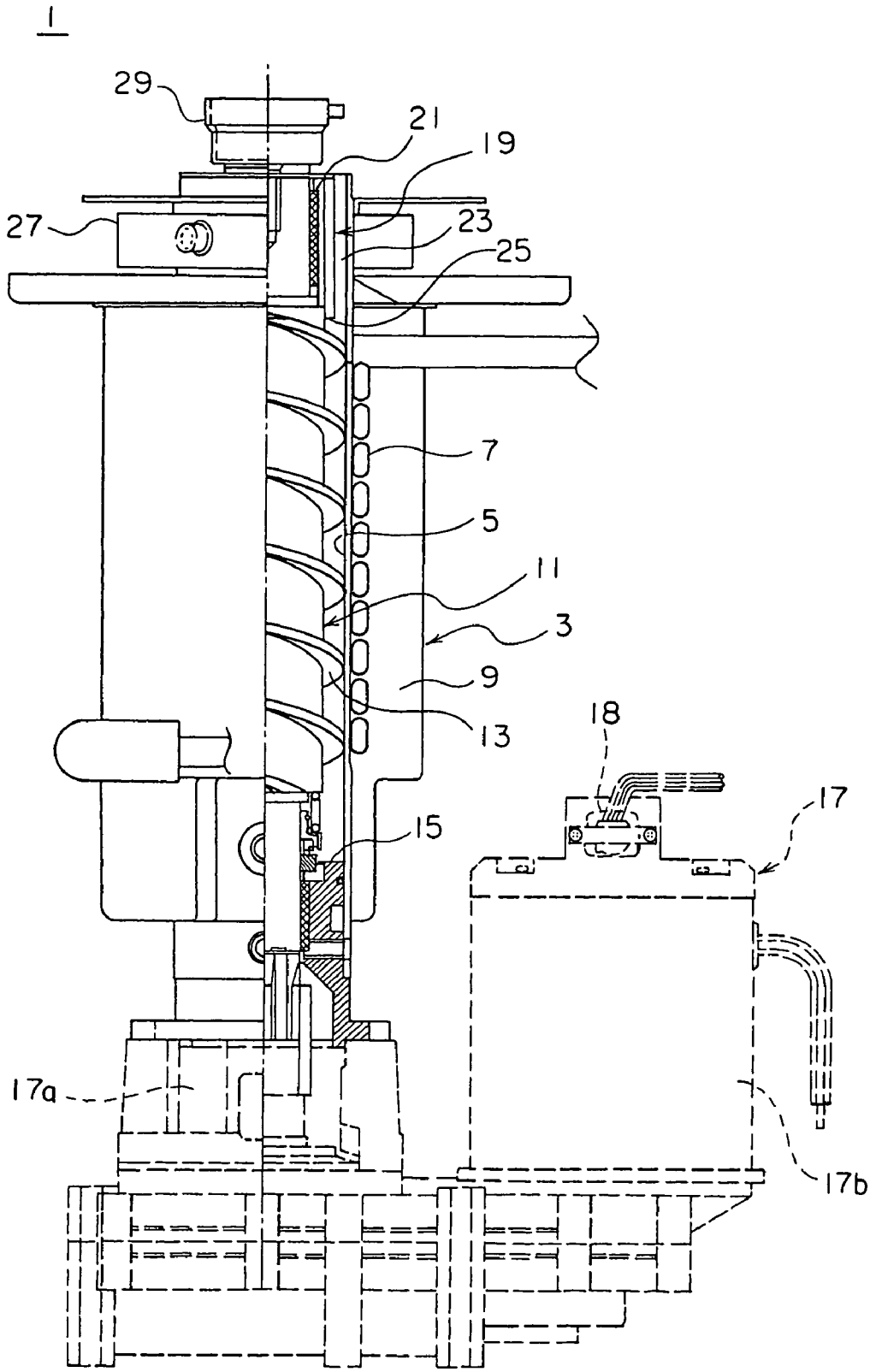
FIG. 1 is a longitudinal sectional view showing an ice making mechanism portion of an auger type ice making machine according to an embodiment of the present invention.

FIG. 1 shows a longitudinal section of an ice making mechanism portion of an auger type ice making machine according to the embodiment of the present invention. In an ice making mechanism portion 3 of an auger type ice making machine 1, there is provided a cylinder 5 formed of metal. A cooling pipe 7 is wound in a spiral fashion around an outer peripheral surface of the cylinder 5. The cooling pipe 7 functions as an evaporator which constitutes a component of a refrigerant circuit described later. The cylinder 5 and the cooling pipe 7 are covered with a heat insulating material 9. Further, an auger 11 is rotatably arranged inside the cylinder 5. The auger 11 has a helical blade 13 formed on its outer peripheral surface. A lower part of the auger 11 is supported by a bearing 15 arranged at the lower end of the cylinder 5. Further, the lower end of the auger 11 is connected to a speed reduction mechanism portion 17*a* of a geared motor 17. Accordingly, the auger 11 is rotated by a drive force of a motor portion 17*b* of the geared motor 17 which is transmitted via the speed reduction mechanism portion 17*a*. Further, mounted to the geared motor 17 is a rotation detecting sensor 18 which detects whether or not the rpm of the motor portion 17*b* is equal to or lower than a predetermined value. A pressure head 19 is arranged in an upper inside portion of the cylinder 5. The pressure head 19 has in the center thereof a bearing portion 21 which rotatably supports the auger 11, and a plurality of ice compression passages 23 are formed outside the bearing portion 21. Further, arranged between each pair of adjacent ice compression passages 23 is a stationary blade 25 which serves to split and guide ice to corresponding one of the ice compression passages 23. A heater 27 is arranged at a position on the outer peripheral surface of the cylinder 5 and located in the outside of the ice compression passages 23. Further, fixed at the upper end portion of the auger 11 is a rotary blade 29 adapted to rotate integrally with the auger 11. Further, mounted around the circumference of the rotary blade 29 is an ice carrier cover 31 (see FIG. 2) for carrying the ice produced as suitable ice particles into an ice storage (not shown).

Figure 2:
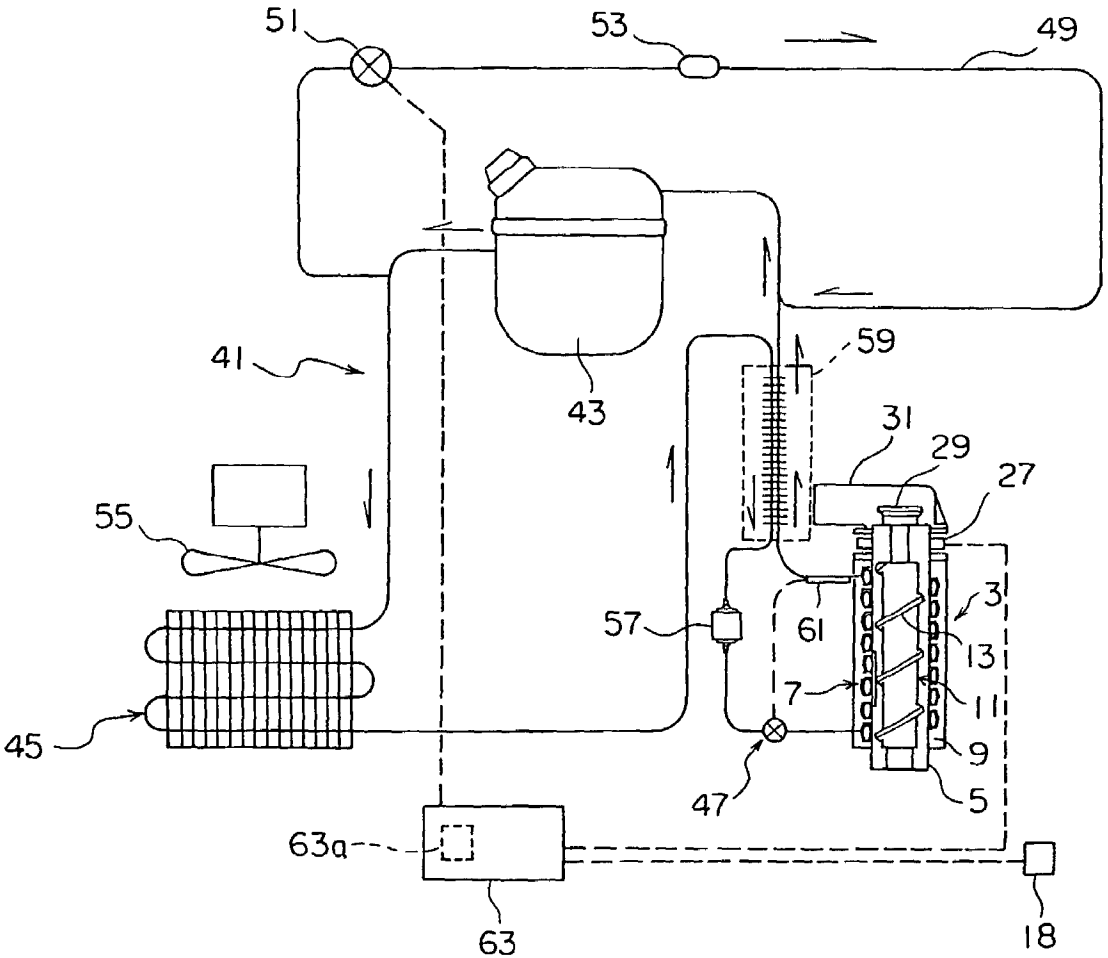
FIG. 2 is a diagram showing the configuration of a refrigeration circuit in the auger type ice making machine of FIG. 1.

Referring now to FIG. 2, description is made on a refrigeration circuit of the auger type ice making machine according to this embodiment. A refrigeration circuit 41 is composed mainly of a compressor 43, a condenser 45, an expansion valve 47, and the cooling pipe 7 serving as an evaporator. The refrigeration circuit 41 is further provided with a bypass means 49. The bypass means 49 communicates between the compressor 43 and the condenser 45 and between the cooling pipe 7 and the compressor 43, and supplies refrigerant on the high pressure side of the refrigeration circuit 41 to the lower pressure side. The bypass means 49 is provided with a hot gas valve 51 and a strainer 53. The hot gas valve 51 serves as an electromagnetic valve for effecting control so as to permit or block flow of hot gas. Further, arranged near the condenser 45 is a motor-driven fan 55 for promoting heat exchange. Further, a drier 57 is provided between the condenser 45 and the expansion valve 47. The refrigerant piping portion in the upstream portion of the drier 57 and the refrigerant piping portion between the cooling pipe 7 and the compressor 43 are capable of heat exchange with each other, that is, they constitute a heat exchanger 59. A temperature sensitive cylinder 61 is mounted in the refrigerant piping portion at the outlet of the cooling pipe 7. The degree of the opening of the expansion valve 47 is adjusted while utilizing temperature detection by the temperature sensitive cylinder 61. Further, the auger type ice making machine 1 is provided with a control means 63 such as a micro computer. The rotation detecting sensor 18, the heater 27, and the hot gas valve 51 are connected to the control means 63 by way of signal lines indicated by dotted lines in the figure. The control means 63 is further provided with a backup timer 63*a*.

Next, description is made on how the auger type ice making machine constructed as described operates. The hot gas valve 51 remains closed during normal ice making operation in which there is no fear of overcooling, so that no refrigerant flows through the bypass means 49. A refrigerant at high temperature and high pressure discharged from the compressor 43 undergoes heat exchange in the condenser 45 where it turns into a liquid refrigerant of low temperature and high pressure and flows towards the expansion valve 47. To attain improved cycle efficiency etc, the liquid refrigerant is subjected to heat exchange in the heat exchanger 59 with a vapor refrigerant that is to be sucked in by the compressor 43. Then, after having moisture removed therefrom by the drier 57, the refrigerant flows into the expansion valve 47. The low temperature refrigerant decompressed in the expansion valve 47 cools the cylinder 5 in the cooling pipe 7 before being sucked in by the compressor 43 via the heat exchanger 59 as described above. The above-described action of the cooling pipe 7 in the refrigerant circuit 41 cools the ice making water supplied into the cylinder 5, forming a layer of ice on the inner surface of the cylinder 5. Further, as the auger 11 rotates inside the cylinder 5, the helical blade 13 thereof scrapes off the layer of ice into sorbet-like ice and carries it upward. As the ice is thus carried upward, it is pushed from below by ice that is continuously pushed upward, to be compressed into a suitable hardness in the ice compression passages 23. As it exits the ice compression passages 23, the ice is severed into a suitable size by the rotary blade 29. The suitable particulate ice thus produced is passed through the ice carrier cover 31 for storage in a conventional, known ice storage (not shown).

It should be noted that the ice making capacity of an ice maker is affected by such conditions as the outside air temperature and water temperature. Therefore, the ice making capacity increases in the winter time when the outside air temperature and the water temperature are low, which may cause overcooling to occur in the ice making machine. Overcooling occurs in the auger type ice making machine when, for example, the balance between the discharge amount of ice and the production amount of ice can no longer be maintained. Hence, overcooling always accompanies the following relationship: ice discharge amount<ice production amount. However, the cylinder does not immediately freeze up after such an unbalance develops, but it takes some time before the freeze up actually occurs. It takes several hours for the ice making machine to finally reach an overcooling state. In view of this, according to this embodiment, the following operation is performed to avoid occurrence of defects due to overcooling. As the overcooling proceeds, a greater load acts on the auger 11 and therefore on the geared motor 17 due to ice clogging or increased ice generation, causing a decrease in the rpm thereof. Based on this phenomenon, the control means 63 monitors detection results from the rotation detecting sensor 18; when the rpm of the geared motor 17 drops to a predetermined threshold value or below, that is, when the rotation detecting sensor 18 turns on, the hot gas valve 51 and the heater 27 are energized and turned on, that is, the hot gas valve 51 opens and the heater 27 initiates heating. As a result, first, the hot gas present between the compressor 43 and the condenser 45 is supplied toward the suction side of the compressor 43 via the bypass means 49, thus raising the suction temperature of the compressor 43 to reduce the ice making capacity. In addition, the heater 27 heats an area surrounding the ice compression passages 23, eliminating ice clogging in the ice compression passages 23 and in their vicinity. This causes an increase in ice discharge amount and also helps to avoid mechanical stoppage of the machine.

Figure 3:
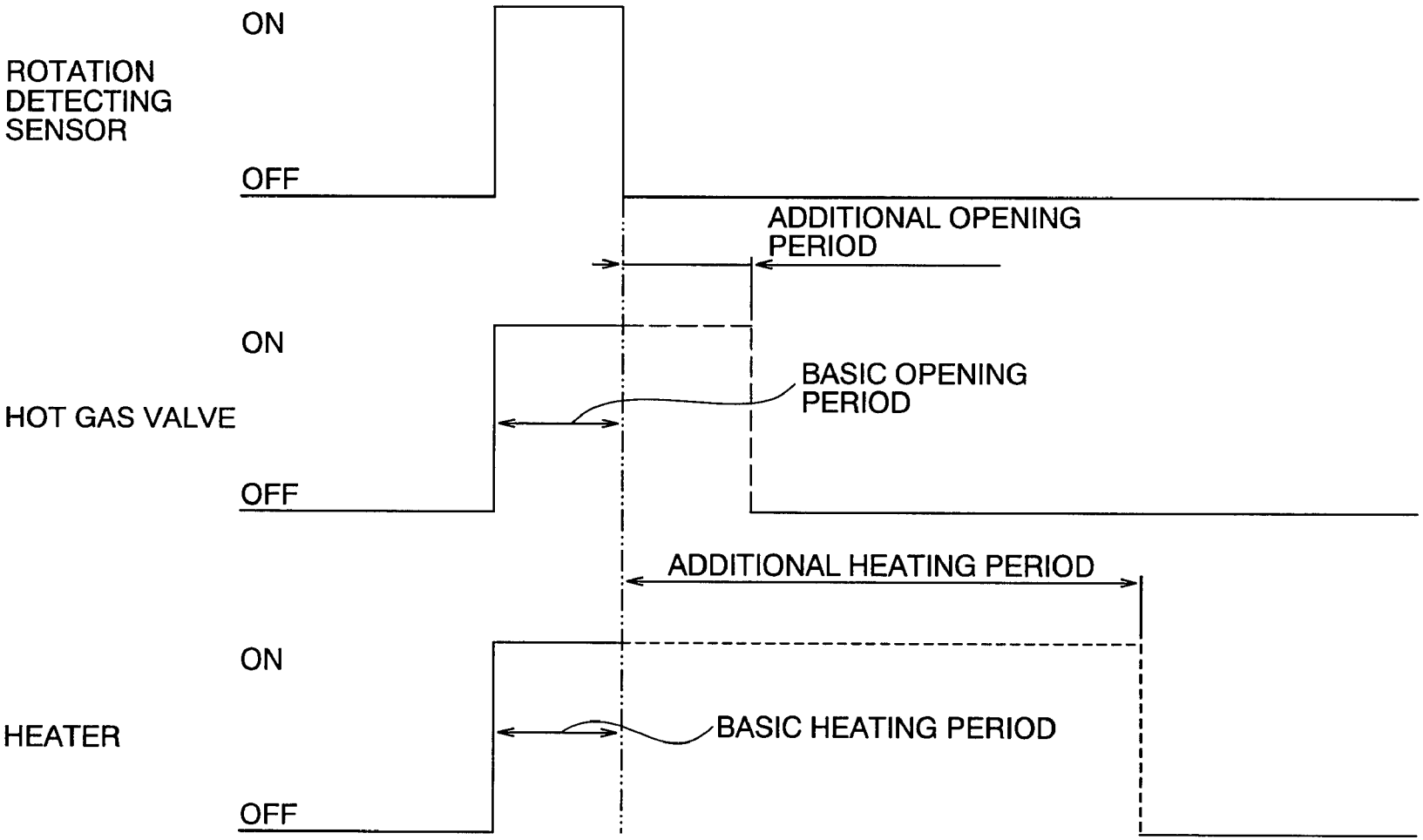
FIG. 3 is a diagram for explaining how a rotation detecting sensor, a hot gas valve, and a heater operate according to the embodiment of the present invention.

Further, in the initial stage of overcooling, it is often the case that the respective rpms of the auger 11 and the geared motor 17 decrease temporarily due to excessive ice making but immediately recover to an unproblematic level. Therefore, a sufficient overcooling-eliminating effect may not be attained if the bypassing of the hot gas and energization of the heater are effected in synchronism with a change in the rpm of the gear motor or the like. Accordingly, in this embodiment, the opening period of the bypass means 49 and the heating period of the heater 27 are controlled as follows. That is, as shown in FIG. 3, the opening period of the bypass means 49 and the heating period of the heater 27 consist of a basic opening period and an additional opening period, and a basic heating period and an additional heating period, respectively. As described above, the basic opening period and the basic heating period begin as the rotation detecting sensor 18 enters its on state, and continue throughout the duration of the on state. Then, even after the rpm of the geared motor 17 recovers to a threshold value, that is, even after the rotation detecting sensor 18 enters its off state, the control means 63 maintains the opening of the hot gas valve 51 and the heating with the heater 27, and starts the counting of the backup timer 63*a*. The additional opening period and the additional heating period begin upon the counting start of the backup timer 63*a* and end upon time-up of the backup timer 63*a*. In this way, the opening period of the bypass means and the heating period of the heater continue without interruption occuring synchronism with a temporary recovery in the rpm of the geared motor 17, making it possible to attain a satisfactory overcooling eliminating effect. Further, the heating period (additional heating period) of the heater is set longer than the opening period (additional opening period) of the bypass means, whereby a sufficient ice-clogging eliminating effect can be secured in the vicinity of the ice compression passages 23 by using the heater 27 which is normally cooled.

As described above, according to this embodiment, the state of "ice discharge amount<ice production amount" is eliminated in advance through a combination of the following operations for each of which a sufficient time period is secured, that is, a reduction in the ice making capacity which is effected by the bypassing of hot gas, and a reduction in the passage resistance in the ice compression passages 23 which is effected by heating using the heater. Further, the passage resistance in the ice compression passages 23 is lessened to increase the ice discharge amount and prevent ice clogging, whereby it is possible to avoid mechanical stoppage of the machine. Further, the bypass means and the heater are controlled, whereby there is no need to stop the machine even when a large amount of ice is to be produced, making it possible to maintain high long-term ice making capacity and also save the user of the trouble of restarting the machine. Furthermore, the heater is operated only when necessary, whereby it is possible to achieve a reduction in electricity charges and avoid a situation where, as is the case when the heater remains energized at all times, ice melts excessively and ice and water are discharged together as a result, or it takes too much time before ice is discharged after starting ice making. Further, it is not necessary to mount such dedicated components as a so-called overcooling temperature detecting circuit and a so-called overload current detecting circuit, and there is no need to use precision components such as a thermistor which can easily induce malfunctions or failures. It is to be noted that the energization of the heater 27 is controlled based on the detection of the geared motor rpm, whereby the same ice-clogging eliminating effect as described above can be attained for ice clogging that occurs irrespective of the ice production amount, such as one occurring when contaminants build up on the inner surface of the ice compression passages 23.

The present invention as described in the foregoing is not limited to the embodiment described above, and may be subject to various modifications.

For example, while in the above embodiment the rotation detecting sensor detects two states, that is, whether or not the rpm is equal to a threshold value or lower, the rotation detecting sensor is not limited to this as long as it provides means for detecting the rpm; it is possible to use means for providing continuous, real-time measurement of the rpm itself, for example.

Further, the detection of the rpm is not limited to that of the motor portion rpm of the geared motor; it is possible to use the rpm of the speed reduction mechanism or the like as an indicator, for example.

Further, the mode for detecting overcooling is not limited to the one in which overcooling is detected by detecting the rpm of the geared motor; other detection modes may be adopted in which, for example, overcooling is detected by detecting the rpm of the auger or stationary blade, or by detecting a torque acting on the auger or on a portion operating integrally therewith, such as the geared motor.

Further, the hot gas valve is not limited to the simple on-off valve as described in the above embodiment, and it is possible to use a valve capable of adjusting the flow rate in a continuous, non-stepwise manner.

Further, the bypassing path for the hot gas is not limited to the one specified in the embodiment described above as long as the hot gas is bypassed from the high pressure side of the refrigeration circuit to the low pressure side.

Further, the heating means is not limited to the one using a heat ray; other heating modes may be adopted such as one using a heat fluid.

What is claimed is:

1. An auger type ice making machine in which ice formed by freezing on an inner peripheral surface of a cylinder of an ice making mechanism portion is scraped off by an auger and is discharged after being suitably compressed in an ice compression passage, the auger type ice making machine comprising:

a refrigeration circuit including a compressor, a condenser, an expansion valve, and an evaporator;

bypass means for supplying a refrigerant on a high pressure side of the refrigeration circuit to a low pressure side;

heating means for heating a vicinity of the ice compression passage;

overcooling detecting means for detecting overcooling in the ice making mechanism portion; and control means for causing the bypass means open in accordance with a detection result from the overcooling detecting means and initiating heating with the heating means at the same time or after the bypass means is opened, and then, ending heating with the heating means after closing the opened bypass means to.

2. An auger type ice making machine according to claim 1, wherein the overcooling detecting means comprises a rotation detecting sensor which detects a rotation corresponding to a rotation of the auger, and wherein when the rotation detected by the rotation detecting sensor drops to a predetermined threshold value or lower, the control means causes the opening of the bypass means and the heating with the heating means to be effected.

3. An auger type ice making machine according to claim 2, wherein even when the rotation detected by the rotation detecting sensor rises to exceed the predetermined threshold value after dropping to the predetermined threshold value or lower, the control means causes each of the opening of the bypass means and the heating with the heating means to continue for a predetermined period of time.

* * * * *